United States Patent [19]

Wilfer

[11] 4,294,399

[45] Oct. 13, 1981

[54] FOLDING BOX

[75] Inventor: Oskar Wilfer, Grünenbach, Fed. Rep. of Germany

[73] Assignee: H. F. & Ph. F. Reemtsma, Hamburg, Fed. Rep. of Germany

[21] Appl. No.: 78,585

[22] Filed: Sep. 21, 1979

[30] Foreign Application Priority Data

Sep. 22, 1978 [DE] Fed. Rep. of Germany ..... 2841257
Apr. 6, 1979 [DE] Fed. Rep. of Germany ..... 2913891

[51] Int. Cl.[3] ..... B65D 5/66
[52] U.S. Cl. ..... 229/44 CB; 229/45 R
[58] Field of Search ..... 229/44 CB, 45

[56] References Cited

U.S. PATENT DOCUMENTS

| | | | |
|---|---|---|---|
| 2,848,152 | 8/1958 | Geiger, Sr. | 229/44 CB X |
| 2,848,153 | 8/1958 | Geiger, Sr. | 229/44 CB X |
| 3,078,029 | 2/1963 | Lacey | 229/44 CB |
| 3,105,591 | 10/1963 | Ahlbor | 229/44 CB X |
| 3,794,238 | 2/1974 | Egli | 229/44 CB |
| 3,823,865 | 7/1974 | Mechnick | 229/44 CB |
| 3,910,486 | 10/1975 | Stone | 229/44 CB X |
| 3,963,173 | 6/1976 | Stone | 229/44 CB |

*Primary Examiner*—Davis T. Moorhead
*Attorney, Agent, or Firm*—Cushman, Darby & Cushman

[57] ABSTRACT

A folding box forming a hinged lid container especially designed for cigarettes and other smoking articles is provided with a stationary box, a rotating cap and a locking mechanism. The rotating cap and stationary box are provided with complementary locking elements within the walls of the box to effect a locking and unlocking of the cap with an accompanying click in the release and the joinder of the locking elements. The locking means form a part of the walls and lie in the respective planes of the walls when the cap is in the closed or open position.

2 Claims, 12 Drawing Figures

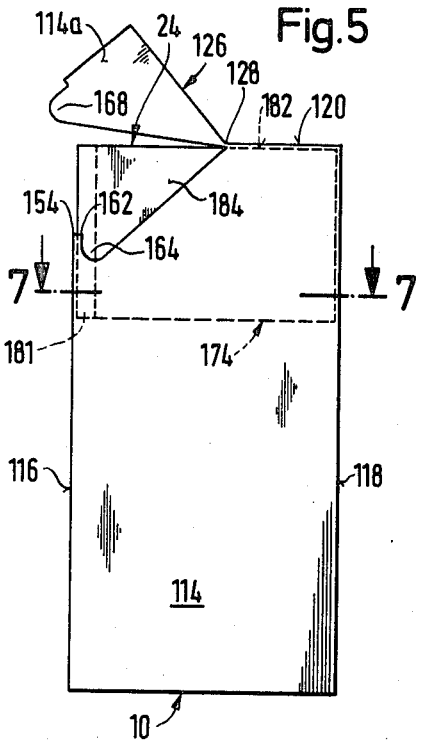
Fig.5
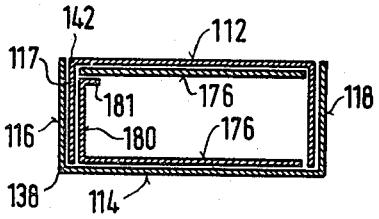
Fig.7
Fig.6
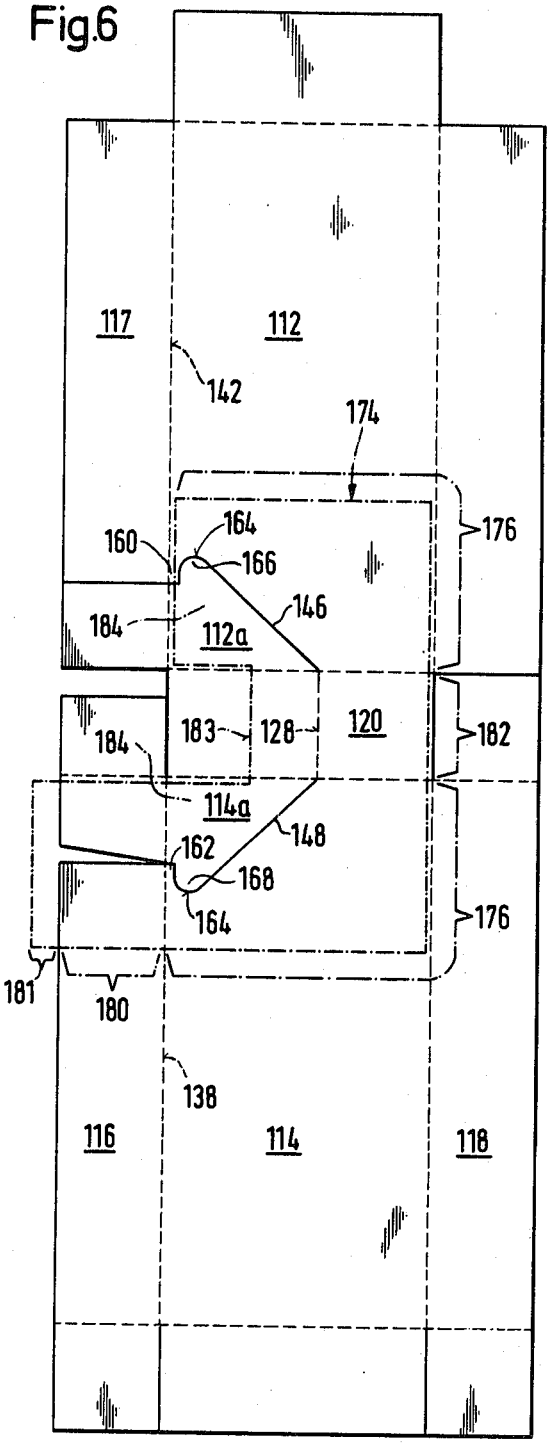

FOLDING BOX

BACKGROUND AND SUMMARY OF THE INVENTION

This invention is concerned with a folding box forming a hinged lid container especially designed for cigarettes and other smoking articles. The folding box consists of cardboard or carton or laminated material.

An object of the invention is to provide a folding cigarette box having a cover or cap which is easily movable and which can be locked in its closed position in order to avoid the cigarettes or the like from falling out.

A further object of the invention is to provide a unitary folding cigarette box which can be opened and closed many times by a single hand operation and producable at low cost on standard machinery.

A further object of the invention is to provide a folding cigarette box having an integral pivoted cap, the cap being locked by an easy lock mechanism which can be used many times without losing its function.

A further object of the invention is to provide a folding cigarette box which is made from the minimum amount of material on standard packaging machinery having a locking mechanism contained within the wall portions which forms a part thereof.

A further object of the invention is to provide a folding box which has locking elements which engage and release in a positive manner and generate a signal or click when opened or closed.

A further object is to provide a folding box for cigarettes and the like that can be locked and unlocked and which presents a smooth walled box with no interrupted surfaces when in a closed position and is especially compatible with the standard cellophane outer wrapping.

Hinged lid containers for smoking articles such as disclosed in U.S. Pat. No. 3,708,108 have been long known in the art. In such containers protruding lock tabs or ears have been provided which functionally interlock with raised score lines. Alternately, such containers have been provided with latching tabs which project from the cover and the container body respectively to latch the cover to the container, see U.S. Pat. No. 3,963,173.

It has also been known to provide such containers with small rounded projections or locking lugs which extend outwardly from the side walls to engage hook like extensions in the cover when in a closed position, see U.S. Pat. No. 2,848,152. Or the hinged cover portion may be constructed so as to be positioned outside of the stationary portion of the container when in a closed position, see U.S. Pat. No. 2,202,280.

It has also been known to provide small rectangular tabs which extend ouwardly from the container body to functionally hold the hinged cover when in a closed position, see U.S. Pat. No. 2,848,153. Other constructions include hinged covers per se or in cooperation with protruding tabs or locking projections, see U.S. Pat. No. 4,114,777, U.S. Pat. No. 4,083,455, U.S. Pat. No. 3,794,238, U.S. Pat. No. 3,823,865, U.S. Pat. No. 3,207,416 and British Pat. No. 642, 988.

All of the above constructions fail to disclose or suggest applicant's novel folding box with a hinged cover having a locking mechanism formed from the wall portions which lies in the same plane of the wall portions and is free from any protruding tabs or ears which projected or extended or lie outside the plane of the wall portions. All such prior constructions contain the common deficiency of failing to provide a simple reusable locking mechanism which is contained within the wall portions to present a smooth uninterrupted wall surface and which is made from the minimum amount of container material on standard packaging machinery and is thus most economical.

The present invention consists of a unitary folding box comprising a front wall, a rear wall, a pair of side walls, a bottom wall and an upper wall; an opening provided in the upper wall in the adjacent front wall and in the pair of side walls extending over the width of the box; an integral cap closing said opening and comprising an upper wall portion, a front wall portion and a pair of side wall portions, said cap wall portions being arranged in the planes of their respective adjacent walls of the box, a pivoted mounting of the cap at the box the swinging axis of which being provided in a wall portion and extending perpendicularly to the side walls; and cooperating locking means provided in adjacent wall portions of the box and the cap.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 5 is a side elevation view of another embodiment of a folding cigarette box, FIG. 6 is a blank from which the folding cigarette box according to FIG. 5 can be constructed, FIG. 7 is a sectional view taken along the line 7—7 of FIG. 5.

DESCRIPTION OF THE PREFERRED EMBODIMENTS

Figure 1:
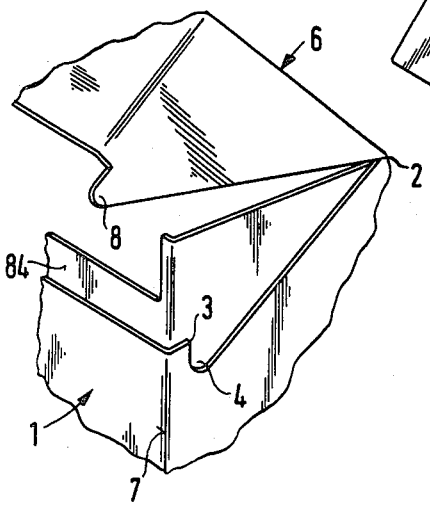
FIG. 1 is a perspective view of a part of the folding cigarette box showing the closure of one corner, according to the present invention.
Figure 8:
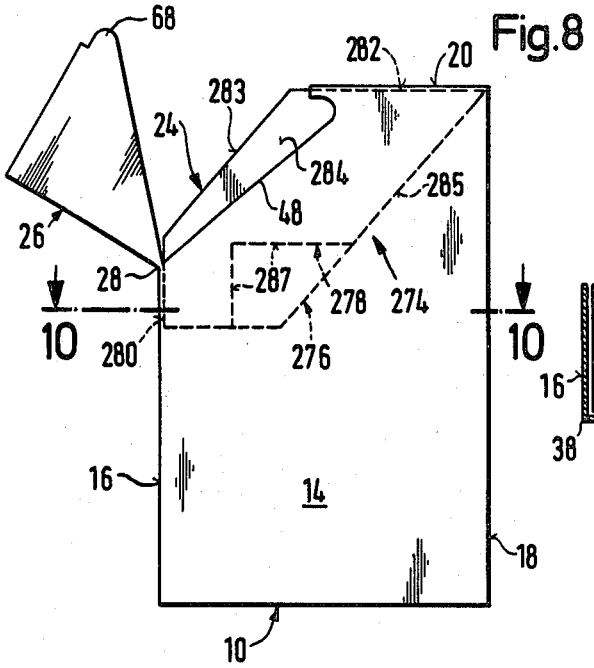
FIG. 8 is a side elevation view of another embodiment of the present invention.
Figure 10:
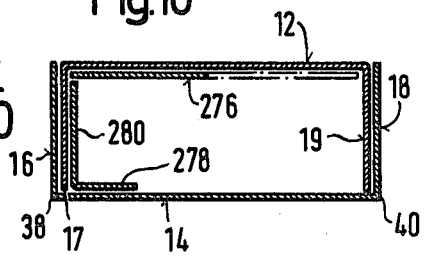
FIG. 10 is a sectional view taken along line 10—10 in FIG. 8.
Figure 11:
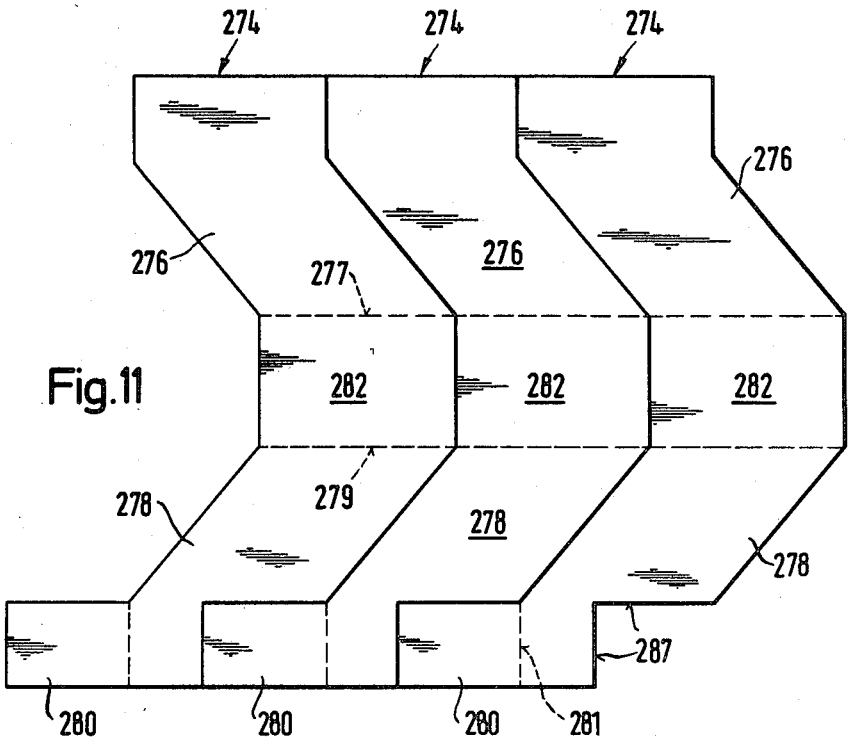
FIG. 11 is a blank from which the insert used in FIGS. 8–10 can be constructed.

FIG. 1 discloses the principle of the present invention by showing the closure of one corner of a unitary folding cigarette box wherein stationary locking means 4 contain rotating locking means 8 in the same plane when the cap 6 is in a closed position. The rotating locking means may be provided in the front and rear walls (FIG. 12) or in the side walls (FIGS. 2, 5 and 8).

Figure 12:
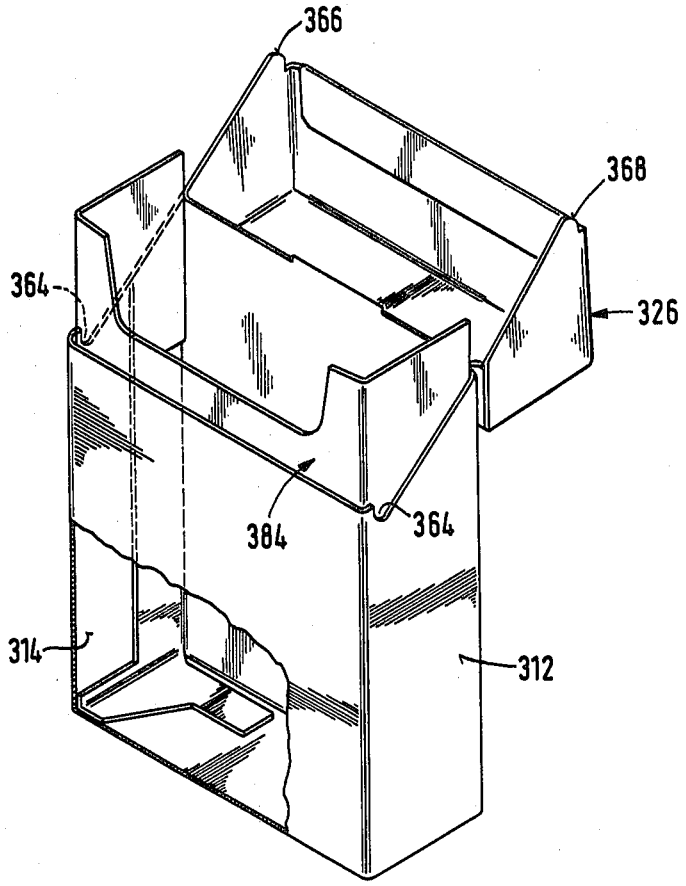
FIG. 12 is an another embodiment of the folding box according to the present invention.

In each of the aforementioned embodiments the stationary locking means 4 and rotating locking means 8 may be provided either near the top of the box (FIGS. 2 and 8) or remote of said top (FIGS. 5 and 12 ).

Figure 2:
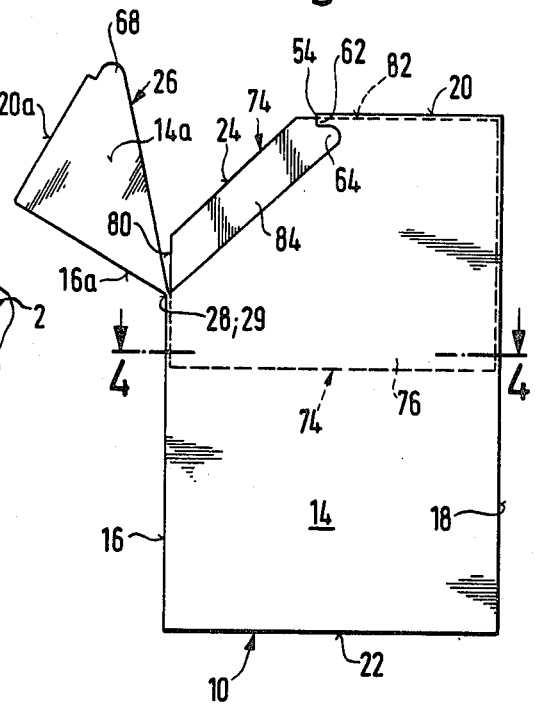
FIG. 2 is a side elevation view of one embodiment of the new folding cigarette box.
Figure 4:
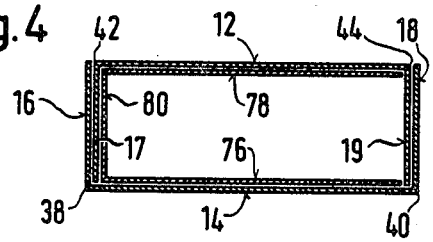
FIG. 4 is a sectional view taken along the line 4—4 of FIG. 2.
Figure 3:
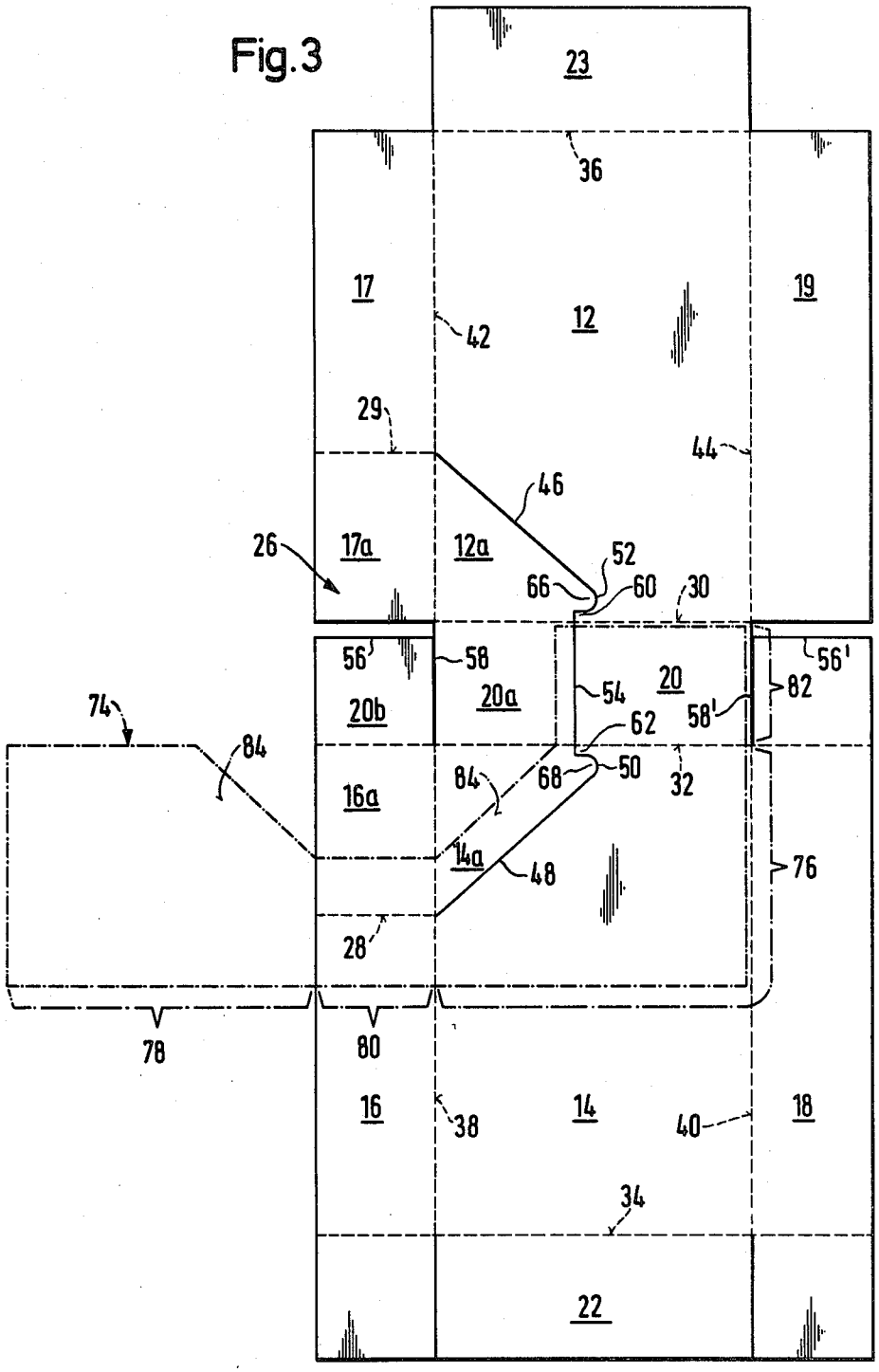
FIG. 3 is a blank from which the box of FIG. 2 can be constructed.

A folding box 10 consists of a pair of parallel side walls 12, 14, a front wall 16, a rear wall 18, an upper wall 20 and a bottom wall 22 (FIGS. 2–4). The box 10 is provided with an opening 24 at its upper front corner. The opening can be closed by means of a cap 26 which is pivotably connected about a folding line 28.

The folding box 10 and the cap 26 may be formed from a one-piece blank (FIG. 3). The upper wall 20 is connected with the pair of side walls 12, 14 by folding lines 30, 32. The side walls are connected with bottom walls 22, 23 by folding lines 34, 36. The side wall 14 is connected with the front wall 16 and the rear wall 18 by folding lines 38, 40 respectively. The side wall 12 is connected with an inner front wall 17 and an inner rear wall 19 by folding lines 30, 32. The side walls are connected with bottom walls 22, 23 by folding lines 34, 36. The side wall 14 is connected with the front wall 16 and the rear wall 18 by folding lines 38, 40 respectively. The side wall 12 is connected with an inner front wall 17 and an inner rear wall 19 by folding lines 42, 44 respectively. When the box is constructed as shown in FIG. 2 the front walls 16, 17, the rear walls 18, 19 and the bottom walls 22, 23 may be adhesively connected with one another respectively so that a standard cigarette box of the shape shown is achieved. It should be clear that the inner walls 17, 19 and 23 could be smaller than the outer walls 16, 18, 22 and could consist only of small flaps.

In order to form the cap 26 a folding line 28 is provided in the front wall 16 and a folding line 29 in the inner front wall 17. The folding lines 28, 29 are equally spaced from the folding lines 30 and 32 respectively and parallel thereto. The folding lines 28, 29 come into congruence after constructing the box and form the swinging axis of the cap 26. Cutting lines 46, 48 are provided in the side walls 12, 14 beginning at the intersections of the folding lines 28, 38 and 29, 42 respectively and extending to the folding lines 30 and 32 respectively. These cutting lines are shown substantially linearly for the greater portion, but alternatively they could also be curved in one or the opposite direction. The cutting lines 46, 48 extend substantially linearly towards the upper wall 20 (FIG. 2). Alternatively they could be formed by a pair of angular or perpendicular cutting lines, e.g., by a first cutting line portion which forms a linear or angular extension of the folding line 28 and 29 respectively and a second cutting line portion extending towards the upper wall 20. The important feature is that the cutting lines define locking means in the planes of the walls.

Both of the cutting lines 46, 48 are connected with cutting lines 50, 52 in the vicinity of the upper wall 20. The cutting lines 50, 52 are connected with cutting line portions continuing to the folding lines 30, 32 respectively. The ends of the cutting lines 50, 52 are connected with one another by a cutting line 54 traversing the upper wall 20. This cutting line 54 is shown as a linear line but alternatively could also be curved. By this cutting design a cap blank may be formed as shown consisting of an upper front wall portion 20*a;* a pair of substantially triangularly shaped side wall portions 12*a,*14*a;* an outer upper wall portion 16*a* and an inner upper wall portion 17*a* and an inner upper wall portion 20*b*. Besides the two cutting lines 56, 58 of the inner wall portion 20*b* all other wall portions of the cap 26 are connected with one another respectively via folding lines 30, 32, 38, 40.

Between the linear extensions of the cutting lines 50, 52 and the adjacent folding lines 32 and 30 respectively there remain side wall portions 60, 62 which define stationary locking means 64, 64 (FIG. 2) provided in the side walls 12, 14. The locking means 64, 64 contain the inwardly extending side wall portions of rotating locking means 66, 68 of side wall portions 12*a,* 14*a* of the cap 26 when the cap is closed. It is essential that the radius of the end portion of the inwardly extending side wall portion of the rotating locking means be greater than a radius drawn to a portion of the stationary locking means to effect a butting surface. The upper wall cutting line 54 as shown has a smaller radius from the swinging axis 28 than the end of the rotating locking means 66, 68 of the cap when the box is constructed. In accordance with this construction in the beginning phase of the opening operation through the rotation of the cap 26 the rotating locking means 66, 68 abut against the inner surface of the stationary locking means 64, 64 thus preventing a further opening movement of the cap. Upon further force and rotation of the cap the resilient side wall portions may spread or bulge. The rotational force and the resiliency of the material combine to move the locking elements into different planes which causes the inwardly extended side wall portions of rotating locking means 66, 68 to rotate away from stationary locking means 64, 64 and side wall portions 60, 62. This is achieved by using a greater rotating force to overcome a remarkable and unexpected resistance provided by the stationary locking means 64 in cooperation with rotating locking means 66, 68.

The engagement and release of the locking elements may be repeated as many times as necessary in order that the contents of the box are removed. The complementary locking elements cooperate to provide a totally novel simple efficient positive locking means which are made from the material in the walls and which are unexpectedly and surprisingly durable and strong in securing the contents of the box. The use of the existing wall material to form the locking elements also results in many other advantages including the optimum use of material. The present invention permits the construction of a smooth walled lockable box which may be made on existing standard machinery and which does not interfere with any customary cellophane wrapping operation.

By continuing the rotation of side wall portions 12*a,* 14*a* the rotating locking means 66, 68 become released from the stationary locking means 64,64. In the unlocking movement an audible or discernable sound or click results. Upon unlocking the resilient side wall portions immediately assume their original flat state and lie in a single plane with the stationary locking means. The cap 26 then can freely be swung into its open or unlocked position.

During the closing movement of the cap the rotating locking means 66, 68 slide along the surfaces of the side wall portions 60, 62. Upon further rotation the rotating locking means are contained within the stationary locking means 64, 64 of the side walls 12, 14 in substantially the same plane. In the locking movement again an audible or discernable sound or click results. The cap then is in its closed or locked position.

In FIGS. 2 to 4 an insert strip 74 is shown in dot and dashes which comprises a pair of inner side walls 76, 78, an intermediate inner front wall 80 and an inner upper wall 82. All of these inner walls are connected with one another by folding lines and the configurations of the insert strip is designed in such manner that in the open position of the cap 26 the inner side walls 76, 78 project above the lower portion of box side walls 14, 12, so that guide surfaces 84, 84, are formed for the cap. Also the inner upper wall 82 projects beyond the upper wall 20. The same is true with respect to the inner front wall 80 which projects beyond the front wall 16. The insert strip 74 therefore defines the opening 24 of the box. The strip may be adhesively connected at one place to the box, e.g., at the inner upper wall 82 to the upper wall 20. Alternatively, guide portions substantially as shown could be suitably fastened to the inside of the rotating cap so that the guide surfaces are carried by the cap.

In the embodiment shown in FIGS. 5 to 7 a cap 126 is provided which corresponds in its shape substantially to the cap 26. The cap 126 is pivoted about a swinging axis 128 which is contrast to the aforementioned structure is arranged in the upper wall 120 of the box. Instead of swinging the cap 26 substantially forwards in order to open the box the cap 126 swings upwardly and rearwardly.

In the middle region of the upper wall 120 a folding line 128 is provided which extends perpendicularly to the side walls 112, 114 when the box is in the constructed position as shown in FIG. 5.

Cutting lines 146, 148 are provided in the side walls corresponding to the cutting lines 46, 48 according to the embodiments of FIG. 3. The cutting lines 146, 148 according to FIG. 6 however begin at the ends of the upper wall folding line 128 and end adjacent the front wall 116 at folding lines 138, 142 as shown. Because of this design of the cutting lines stationary locking means 164, 164 are formed in the side walls 112, 114 and rotating locking means 166, 168 are formed in the side wall portions 112*a*, 114*a*, cooperating as the lock means as described in connection with the embodiment of FIGS. 2 to 4.

An insert strip 174 shown in dot and dashes in FIG. 6 is modified with respect to the strip 74. The inner side walls of the strip 174 are rectangular and form therefore guide walls 184 closing the opening of the box at both sides as shown. The inner front wall may be of the same height as the inner side walls so that the opening also at the front side may be closed. The front edge 183 of the inner upper wall 182 of the insert strip 174 defines an opening in the box as shown. The inner front wall 180 is connected with an inner side wall portion 181 which may be adhesively connected to the inner side wall 176 of the strip when the box is constructed. Alternatively, guide walls may be affixed to the cap as explained above so that the rotating cap carries the guide side walls.

The principle in opening and closing the cap 126 is the same as described in connection with FIGS. 2 to 4. Again, it is important that the rotating locking means 166, 168 be contained by stationary locking means 164 when the cap is closed. Again, in the opening phase of the cap 126 the rotating locking means 166, 168 abut against the inner surface front walls of the stationary locking means 164. The cap 126 can be swung upwards and rearwards through rotational force to uncover the opening of the box. When the cap is closed again the rotating locking means 166, 168 slide along the surfaces of the side wall webs 160, 162 and snap into the stationary locking means 164, 164 of the side wall 112, 114 when the closed position is reached. The cap is thus locked.

Figure 9:
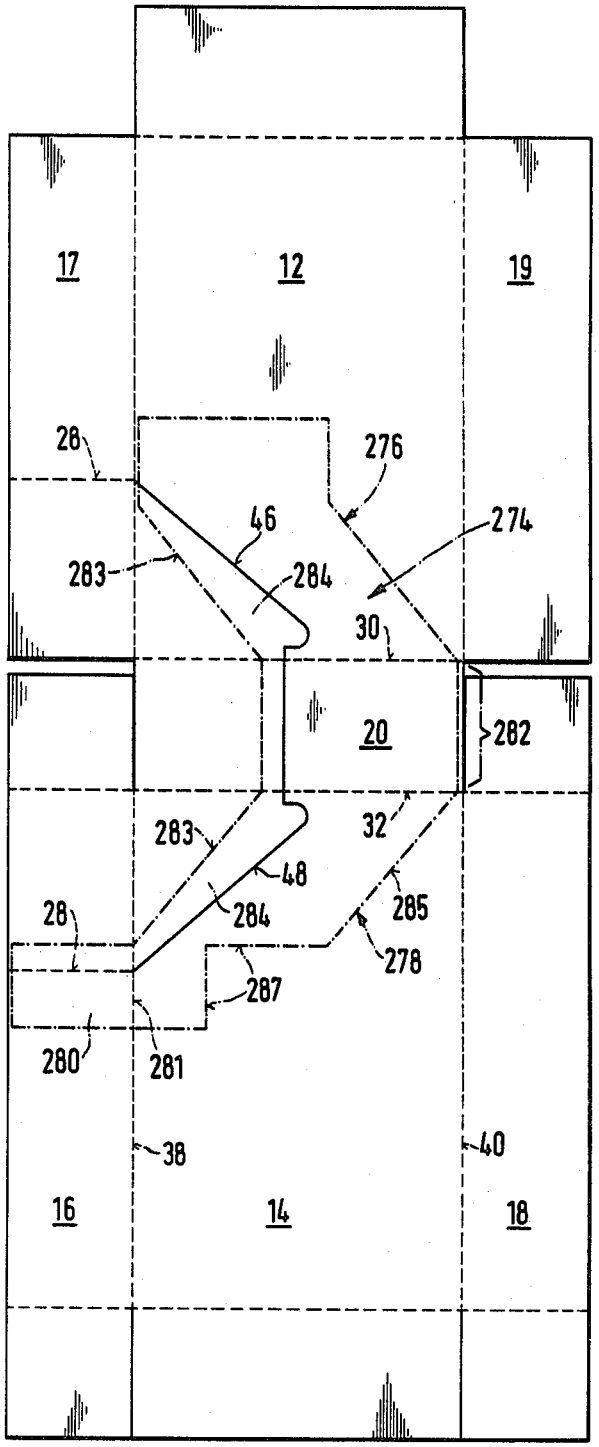
FIG. 9 is a blank from which the folding box according to FIG. 8 can be constructed.

FIGS. 8 to 11 show a folding box which differs from the one shown in FIGS. 2 to 4, only by the provision of the insert strip 274, which is indicated in dash-dot lines in FIG. 9. Essential advantageous features of the insertion strip 274, are that it does not project beyond the contours of the box outline, and that it is constructed in a manner which saves material. The insertion strip 274 consists of both inner side walls 276, 278, having folding lines 277, 279 which pass through insert lengthwise. The folding lines 277, 279 lie on the folding lines 30, 32 when the box is constructed. The upper edges 283, 283, do not extend parallel to the upper edges 46, 48, but are instead angularly oriented so that the guide surfaces 284 become narrower in the downward direction to the pivoting axis. All inner walls 276, 278, 280, 282 of the insertion strip 274 are located opposite the neighbouring walls, 12, 14, 20, 16 in the opening 24. As a result, there is formed a circumferential guide surface rim for the cap 26. To fix in place the insertion strip 274, the inner upper wall 282 may be adhesively connected to the inner side of the upper wall 20, in accordance with FIG. 9. Alternatively, the guide walls may be affixed to the cap as explained above.

FIG. 12 shows a further embodiment of present invention wherein the stationary locking means 364 have been provided in the side walls 312, 314 of a hinge lid box 300 made according to U.S. Pat. No. 4,114,777. The rotating locking means 366, 368 have been provided in the lower most portions of the lid 350 and again lie in the same plane as the stationary locking means 364. As in the embodiments according to FIG. 2, 5 and 8 an insert strip 394 acts as a guide surface for the rotating locking means 366, 368. Alternatively, the guide surfaces may be affixed to the lid as explained above.

The foregoing fully reveals the present invention so that those skilled in the art, by applying current knowledge, can readily adapt it for various applications. It will be apparent to those skilled in the art that modifications may be made thereto without departing from the spirt and scope of the invention as disclosed and defined in the following claims.

I claim:

1. A unitary folding box for cigarettes and smoking articles comprising a single blank having a front wall, a rear wall, a pair of side walls, an upper wall, a bottom wall, and a cap formed from a portion of said front, side and upper walls which pivots about an axis in the plane of a wall in opening and closing; complementary locking means formed from a portion of said walls, said locking means having rotating locking means and stationary locking means, one of which is associated with said cap and the other of which is associated with said box, both said rotating locking means and said stationary locking means lying in the same plane as said wall portions from which they are formed.

2. The folding box as claimed in claim 1 wherein said rotating locking means has inwardly extending wall portions, the radius of which from the pivotal axis to its outermost point is greater than the radius from the pivotal axis to the end point of the stationary locking means whereby said cap may be rotated about the pivotal axis from a closed to an open position.

* * * * *